US010527977B2

(12) United States Patent
Harashima

(10) Patent No.: US 10,527,977 B2
(45) Date of Patent: Jan. 7, 2020

(54) IMAGE FORMING APPARATUS AND RECORDING MEDIUM

(71) Applicant: KONICA MINOLTA, INC., Chiyoda-ku, Tokyo (JP)

(72) Inventor: Yu Harashima, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/293,137

(22) Filed: Mar. 5, 2019

(65) Prior Publication Data

US 2019/0286018 A1 Sep. 19, 2019

(30) Foreign Application Priority Data

Mar. 14, 2018 (JP) ..... 2018-046219

(51) Int. Cl.
*G03G 15/16* (2006.01)

(52) U.S. Cl.
CPC ..... *G03G 15/1665* (2013.01)

(58) Field of Classification Search
CPC ..... G03G 15/1665; G03G 15/1675; G03G 15/168; G03G 15/55
USPC ..... 399/8, 24, 25, 38, 66, 121, 297
See application file for complete search history.

(56) References Cited

U.S. PATENT DOCUMENTS 5,909,605 A * 6/1999 Nishizawa ..... G03G 15/1675 399/66
9,395,658 B2 * 7/2016 Wada ..... G03G 15/1665
9,477,181 B2 * 10/2016 Hironaka ..... G03G 15/1675
9,977,399 B2 * 5/2018 Kobayashi ..... G03G 21/20

FOREIGN PATENT DOCUMENTS

JP 2003195700 A 7/2003
JP 2010026189 A 2/2010

* cited by examiner

*Primary Examiner* — Hoan H Tran
(74) *Attorney, Agent, or Firm* — Holtz, Holtz & Volek PC

(57) ABSTRACT

Provided is an image forming apparatus including a transfer mechanism which transfers a toner image formed on a photosensitive member onto a transfer receiving member, wherein the transfer mechanism includes a conductive member having resistance whose current-voltage characteristic changes by energization, and the image forming apparatus further includes a detector which detects a resistance value when currents or voltages of two or more levels are switched from one to another and applied to the conductive member, and a hardware processor which computes a slope of the current-voltage characteristic from the resistance value detected by the detector and determines a deterioration state of the conductive member by the slope.

10 Claims, 7 Drawing Sheets

IMAGE FORMING APPARATUS AND RECORDING MEDIUM

BACKGROUND

Technical Field

The present invention relates to an image forming apparatus and a recording medium.

Description of the Related Art

Electrophotographic image forming apparatuses have been widely used which typically form an image on a sheet of paper using a toner.

In a known image forming apparatus having a configuration of this type, for example, a toner image formed on a surface of a photosensitive member is transferred onto a surface of an intermediate transfer belt by a primary transfer mechanism and thus the toner image is carried by the intermediate transfer belt. Subsequently, the toner image carried by the intermediate transfer belt is transferred onto a sheet of paper by a secondary transfer mechanism.

At the primary transfer mechanism, a predetermined electric field is created by a transfer bias applied to a transfer roller between the intermediate transfer belt defining a nipper and a photosensitive member. Under the effect of the electric field, the toner moves from the photosensitive member to the intermediate transfer belt and, at the primary transfer mechanism, the toner image on the surface of the photosensitive member is transferred to the surface of the intermediate transfer belt.

At the primary transfer mechanism, in order to realize excellent transfer property, it is necessary to create an appropriate electric field at the nipper of the primary transfer mechanism. Meanwhile, a resistance value of a conductive member such as the transfer roller fluctuates due to factors such as chronological degradation. In view of this, various techniques have been proposed such as a technique for determining the life of the transfer roller (Japanese Patent Application Laid-Open No. 2003-195700) and a technique for maintaining the resistance value of the transfer roller at a constant level (Japanese Patent Application Laid-Open No. 2010-26189) for suppression of deterioration of image quality caused by the fluctuation of the resistance value.

However, when the resistance value of the transfer roller is to be measured to control the resistance value, the actually measured value will be generally obtained as a comprehensive value associated with not only the transfer roller but also the primary transfer mechanism as a whole including the transfer roller.

As a result, possible fluctuations in the resistance values of components other than the transfer roller cannot be identified, which may necessitate replacement of the entire primary transfer mechanism. The time to replace the primary transfer mechanism may be reached even when degradation of the transfer roller as such is not so significant that the replacement is actually necessitated. This is a factor that causes increase in the cost.

Also, if a device has the feature for measuring the resistance values of the respective components included in the primary transfer mechanism, the size of the device as well as its cost will increase.

SUMMARY

An object of the present invention is to make it possible to replace the conductive member at an appropriate point in time in an image forming apparatus.

To achieve at least one of the abovementioned objects, according to a first aspect of the present invention, an image forming apparatus reflecting one aspect of the present invention comprises:

a transfer mechanism which transfers a toner image formed on a photosensitive member onto a transfer receiving member, the transfer mechanism includes a conductive member having resistance whose current-voltage characteristic changes by energization;

a detector which detects a resistance value when currents or voltages of two or more levels are switched from one to another and applied to the conductive member; and a hardware processor which computes a slope of the current-voltage characteristic from the resistance value detected by the detector and determines a deterioration state of the conductive member by the slope.

According to a second aspect of the present invention, a recording medium reflecting one aspect of the present invention comprises a non-transitory computer readable storage medium storing a program for a computer of an image forming apparatus, the image forming apparatus including a transfer mechanism including a conductive member having resistance whose current-voltage characteristic changes by energization and transferring a toner image formed on a photosensitive member onto a transfer receiving member, and a detector which detects a resistance value when currents or voltages of two or more levels are switched from one to another and applied to the conductive member, the program causing the computer to:

compute a slope of the current-voltage characteristic from the resistance value detected by the detector; and determine a deterioration state of the conductive member by the slope.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiment of the present invention will be described with reference to the drawings. However, the scope of the invention is not limited to the disclosed embodiments.

[Configuration of the Image Forming Apparatus]

First, the configuration of the image forming apparatus according to the present embodiment will be described.

Figure 1:
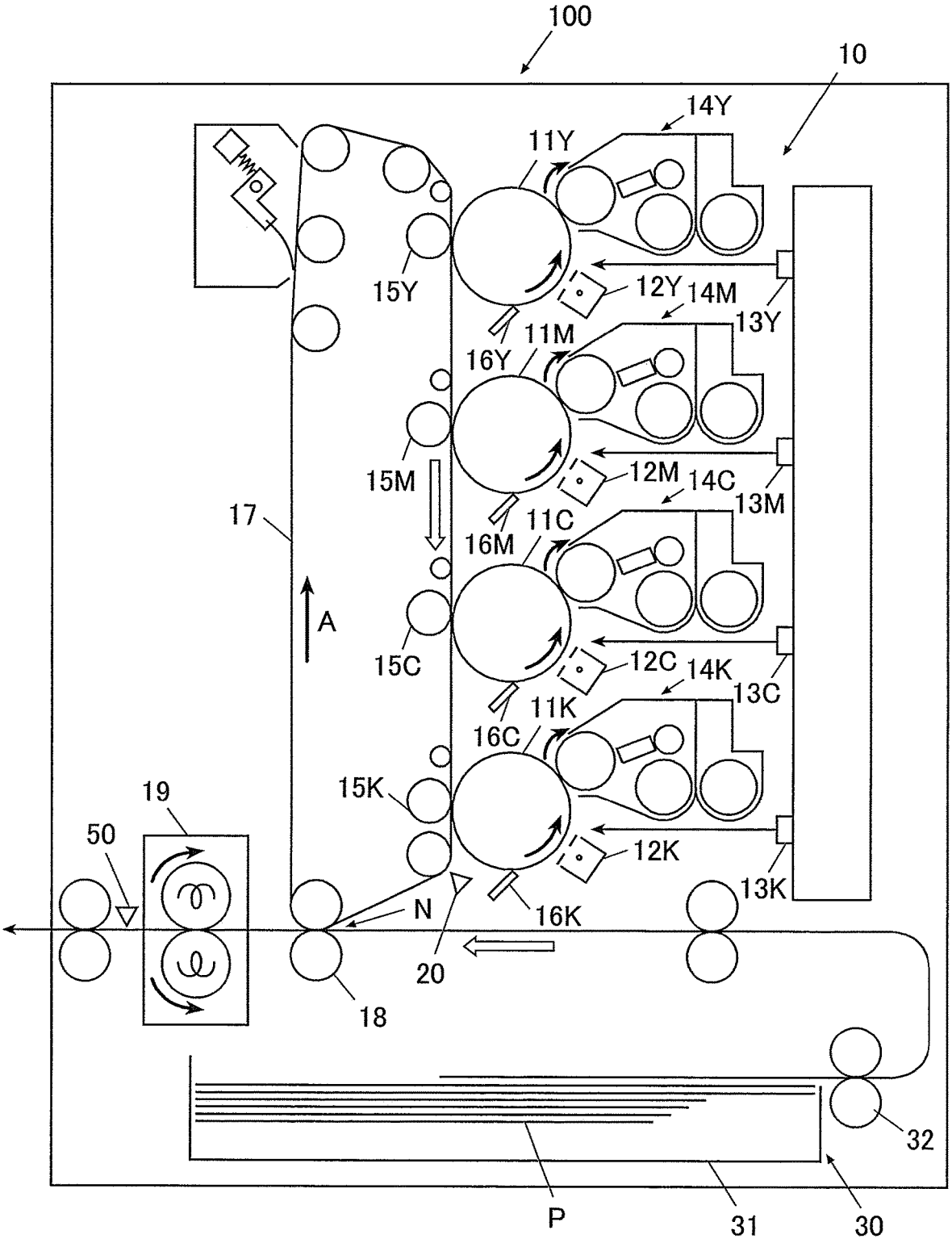
FIG. 1 is a schematic configuration diagram of an image forming apparatus according to an aspect of the present invention.

FIG. 1 is a diagram that illustrates the schematic configuration of the image forming apparatus 100.

Figure 4:
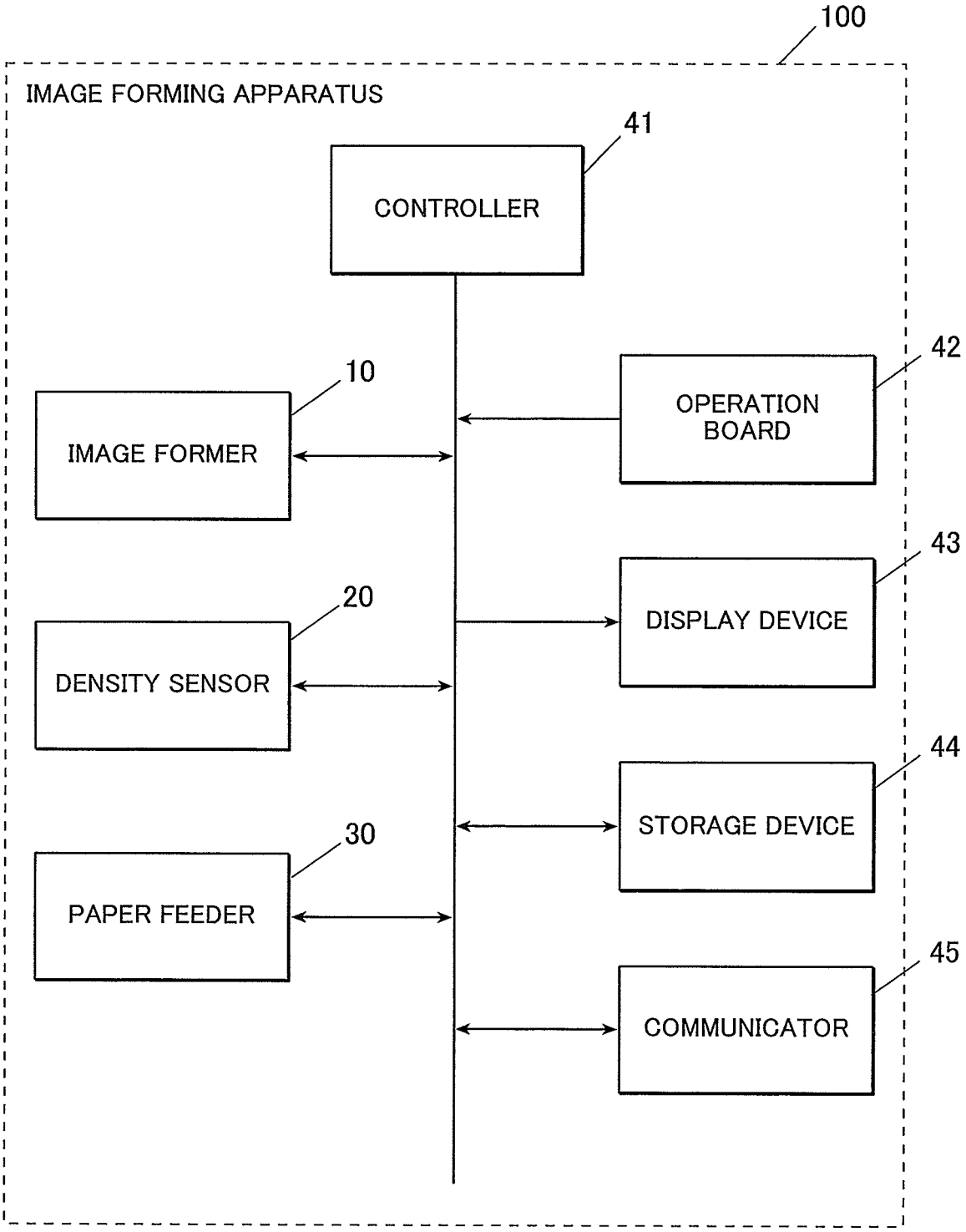
FIG. 4 is a functional block diagram illustrating features associated with control of the image forming apparatus.

As illustrated in FIG. 1, the image forming apparatus 100 may include, for example, an image former 10, a density sensor (density detector) 20, a paper feeder 30, and a controller 41 (see FIG. 4).

The image former 10 includes photosensitive member drums 11Y, 11M, 11C, 11K; electrically charging devices 12Y, 12M, 12C, 12K; exposure devices 13Y, 13M, 13C, 13K, developing mechanisms 14Y, 14M, 14C, 14K; primary transfer rollers 15Y, 15M, 15C, 15K; photosensitive member cleaners 16Y, 16M, 16C, 16K, which correspond to one of the colors including yellow (Y), magenta (M), cyan (C), and black (K), respectively; intermediate transfer belts 17, which are transfer receiving members; secondary transfer rollers 18; and a fuser 19.

The electrically charging devices 12Y, 12M, 12C, 12K uniformly charge the photosensitive member drums 11Y, 11M, 11C, 11K.

The exposure devices 13Y, 13M, 13C, 13K are configured by a laser light source, a polygon mirror, a lens, etc. and scan and expose the surfaces of the photosensitive member drums 11Y, 11M, 11C, and 11K with a laser beam on the basis of image data of each color to form an electrostatic latent image.

The developing mechanisms 14Y, 14M, 14C, 14K attach a toner of each color to the electrostatic latent image on the photosensitive member drums 11Y, 11M, 11C, 11K and perform development. The toner includes toner particles and a carrier for charging the toner particles. As the toner particles, various known ones can be used.

The primary transfer rollers 15Y, 15M, 15C, 15K bias the intermediate transfer belt 17 from the back side (the side opposite to the toner image formation surface) towards the photosensitive member drums 11Y, 11M, 11C, 11K.

It should be noted that the primary transfer rollers 15Y, 15M, 15C, 15K, the intermediate transfer belt 17, and the photosensitive member drums 11Y, 11M, 11C, 11K constitute the primary transfer mechanism (transfer mechanism).

Figure 2:
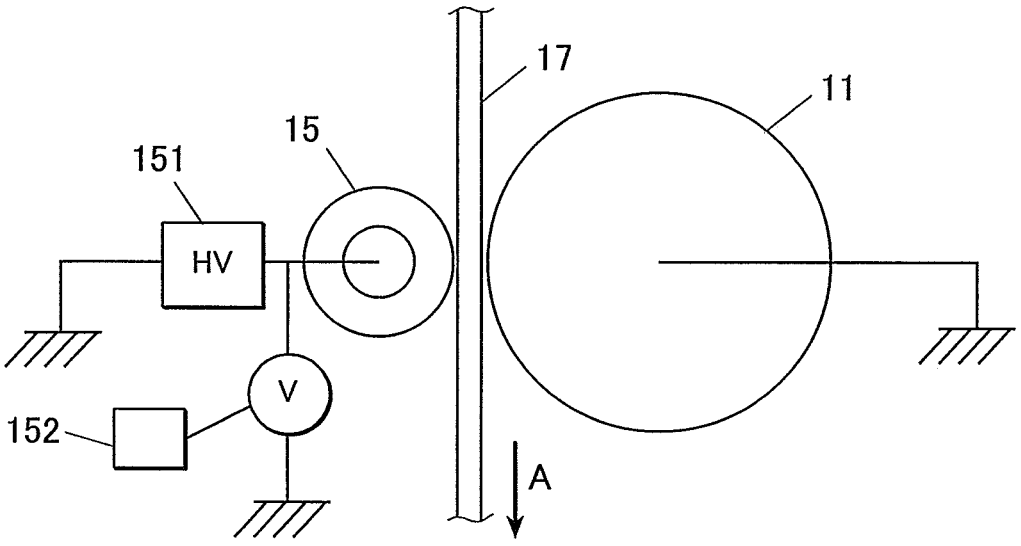
FIG. 2 is a diagram illustrating a primary transfer roller and neighboring components in an image former.

FIG. 2 is a diagram that illustrates the primary transfer roller 15 and neighboring components.

As illustrated in FIG. 2, a predetermined constant voltage or constant current is applied to the primary transfer rollers 15Y, 15M, 15C, 15K by a transfer high-voltage power supply 151. The toner images formed on the photosensitive member drums 11Y, 11M, 11C, 11K are respectively transferred onto the intermediate transfer belt 17 by the electrostatic action of the primary transfer rollers 15Y, 15M, 15C, 15K to which the constant voltage or the constant current is applied (primary transfer). As a result, a color toner image resulting from the overlapping toner images of four colors is formed on the intermediate transfer belt 17.

Figure 3:
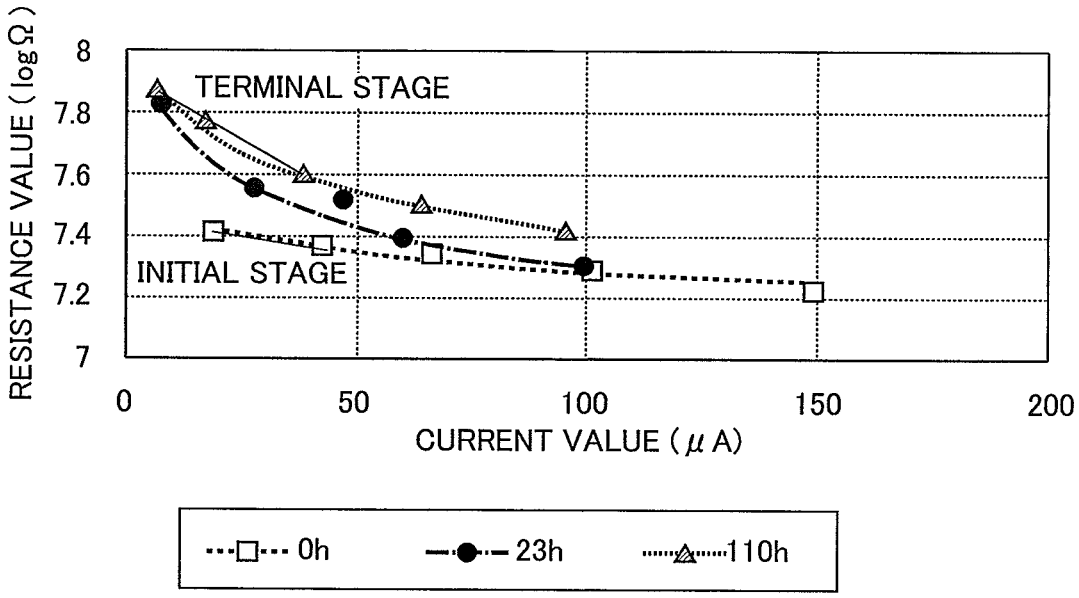
FIG. 3 is a diagram illustrating an example of change in the resistance value in relation to the energization time of the primary transfer roller.

Here, FIG. 3 is an example of a graph illustrating the change of the resistance value of the primary transfer roller 15 in relation to the energization time. In FIG. 3, the horizontal axis indicates the current value (μA) and the vertical axis indicates the resistance value (log Ω).

The primary transfer roller 15 is an ion conductive member having a resistance value whose electrical characteristic (current-voltage characteristic) changes in accordance with the energization.

Specifically, as illustrated in FIG. 3, the primary transfer roller 15 has different resistance values in relation to the current at the initial stage of use and at the terminal stage of use. At the terminal stage of use, according to the electrical characteristic of the primary transfer roller 15, the resistance value is high on the low-current side and the slope of the graph indicating the relationship between the current and the resistance tends to become large.

In the present embodiment, the processing is performed in which this characteristic is taken advantage of and the resistance values when the currents of two levels are switched between and applied to the primary transfer roller 15 periodically (at each predetermined inspection point in time) are measured by the resistance detector (detector) 152 to determine the deterioration state of the primary transfer roller 15 based on the slope of the relationship between the current and the voltage. This processing will be described later in detail.

Referring back to FIG. 1, the photosensitive member cleaners 16Y, 16M, 16C, 16K remove the toners remaining on the surfaces around the photosensitive member drums 11Y, 11M, 11C, 11K after the transfer processing.

The intermediate transfer belt 17 is an endless belt member and stretched by a plurality of rollers (a drive roller, a tension roller, and a driven roller) and is driven to rotate in the direction indicated by the arrow A in FIG. 1.

It should be noted that the intermediate transfer belt 17 needs to have a desired transfer property but is not limited in terms of its material and thickness. For example, an elastic intermediate transfer belt made from a material having elasticity at least in its surface may be used as the intermediate transfer belt 17.

The secondary transfer roller 18 transfers the color toner image formed on the intermediate transfer belt 17 in its entirety onto one surface of a sheet of paper P that is fed from the paper feeder 30 (secondary transfer).

The fuser 19 fixes the toner transferred on the sheet of paper P onto the same sheet of paper P by heating and pressing.

The density sensor 20 may be a reflective photosensor.

The density sensor 20 is arranged, for example, at a position which is more downstream than the most downstream photosensitive member drum 11K in the direction of rotation of the intermediate transfer belt 17 and is more upstream than the nip position of the secondary transfer roller 18.

The density sensor 20 may measures an optical reflection density of the images of the Y, M, C, and K colors when these images are formed on the intermediate transfer belt 17.

The paper feeder 30 is provided at a lower section of the image forming apparatus 100 and includes a removable paper feed cassette 31. The sheets of paper P accommodated in the paper feed cassette 31 is conveyed onto the conveyance route one at a time from the uppermost one by a paper feed roller 32.

FIG. 4 is a block diagram that illustrates the functional configuration of the image forming apparatus 100.

As illustrated in FIG. 4, the controller 41 may be connected to an operation board 42, a display device 43, a storage device 44, a communicator 45, an image former 10, a density sensor 20, and a paper feeder 30.

The controller 41 may be configured by a central processing unit (CPU), a read only memory (ROM) device, and a random access memory (RAM) device, etc. and comprehensively controls the processing operations of the individual components of the image forming apparatus 100. The CPU reads out various processing programs stored in the ROM device, deploys them in the RAM device, and executes various processes according to the deployed programs.

The operation board 42 includes a touch panel configured so as to cover the display screen of the display device 43 and various operation buttons such as numeric buttons, a start button, and the like and outputs an operation signal based on the operation by a user to the controller 41.

The display device 43 is configured by a liquid crystal display (LCD) and displays various screens in accordance with the instruction of a display signal input from the controller 41.

The storage device 44 is configured by a storage device such as non-volatile semiconductor memory device, a hard disk, etc. and stores data or the like associated with various processes.

The communicator 45 performs transmission and reception of data with an external device connected to a network such as a local area network (LAN).

It should be noted that as the image forming apparatus 100, other than the above-described configuration, may have a configuration in which, for example, an image reader (ICCU) 50 is provided on the downstream side of the fuser 19 so as to read the image of the sheet of paper P that has been subjected to the fixing process by the fuser 19.

[Operation of the Image Forming Apparatus]

Next, the operation of the image forming apparatus 100 will be described.

<First Deterioration State Determination Processing>

The image forming apparatus 100 in the present embodiment determines the deterioration state of the primary transfer roller 15 by using the characteristic of the primary transfer roller 15, i.e., the fact that the electrical characteristics of the resistance value changes in accordance with the energization, and determines whether or not the point in time to replace the primary transfer roller 15 has been reached. The first deterioration state detennination processing will be described below.

Figure 5:
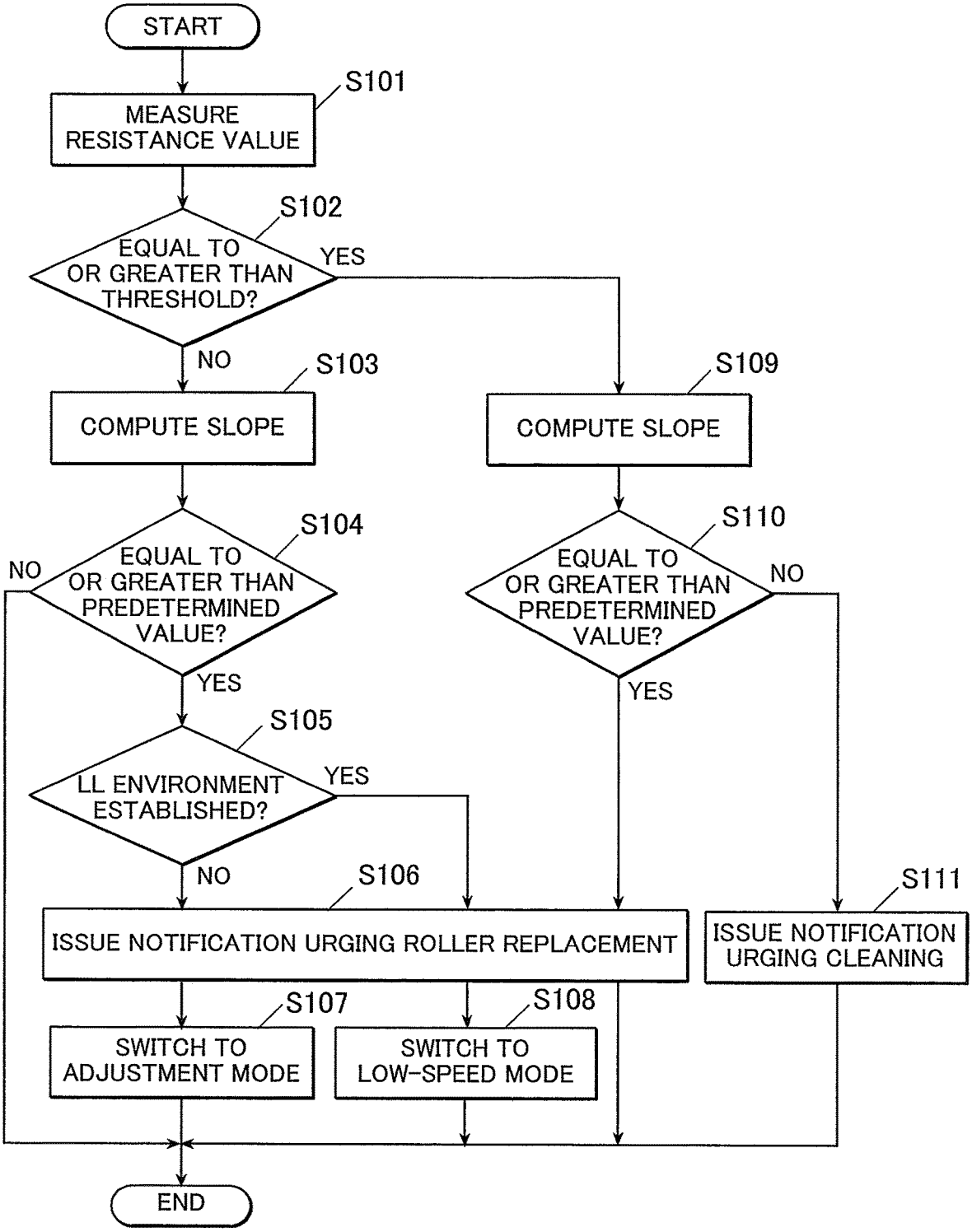
FIG. 5 is a flowchart illustrating a first deterioration state determination processing.

FIG. 5 is a flowchart illustrating the first deterioration state determination processing.

The controller 41 starts the deterioration state determination processing in response to the preset inspection point in time having been reached, which is used as a trigger to start the processing.

As illustrated in FIG. 5, first, the controller 41 switches between and applies currents (a1, a2) of two levels and measures the resistance values (R1, R2) (step S101).

It should be noted that, in place of the currents, voltages of two levels may be switched between and applied so as to measure the resistance values.

Also, while explanations are given on the assumption that the currents (or voltages) of two levels are applied so as to measure the resistance values, currents (or voltages) of three or more levels may be applied to measure the resistance values.

Subsequently, the controller 41 determines whether or not the measured value is equal to or larger than a preset threshold (e.g., to the eighth power or more) (step S102).

In addition, if the measured value is less than the threshold (No in the step S102), the controller 41 computes the slope using the current values (a1, a2) and the resistance values (R1, R2) (step S103).

Figure 6:
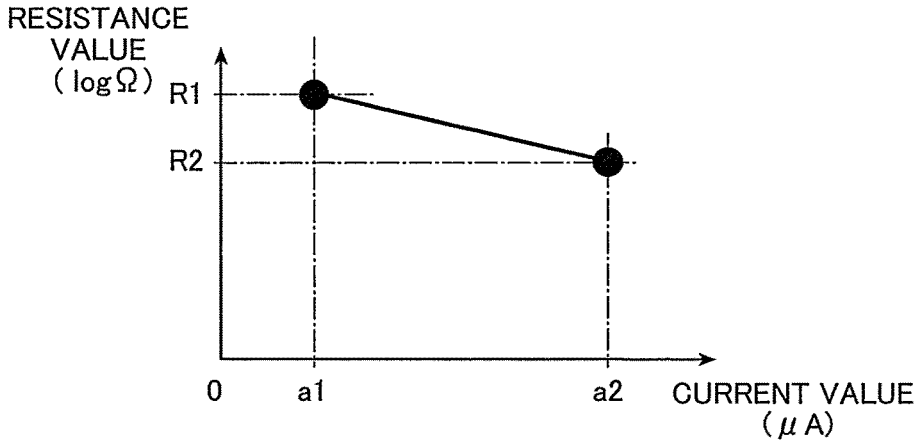
FIG. 6 is a diagram for explanation of computation of a slope.

FIG. 6 is an example of a graph in which the resistance values are plotted with respect to the current value. In FIG. 6, the horizontal axis indicates the current value (μA) and the vertical axis indicates the resistance value (log Ω).

As illustrated in FIG. 6, the slope can be computed in accordance with the expression $|(R2-R1)/(a2-a1)|$.

Subsequently, the controller 41 determines whether or not the value of the computed slope is equal to or greater than a preset predetermined value (e.g., equal to or greater than 0.01) (step S104).

In addition, if the value of the computed slope is smaller than the predetermined value (No in the step S104), the controller 41 terminates this processing, in other words, the controller 41 determines that the primary transfer roller 15 is in an available state and continues to use the same primary transfer roller 15.

On the other hand, if the value of the computed slope is equal to or larger than the predetermined value (Yes in the step S104), then the controller 41 determines whether or not the regions surrounding the image forming apparatus 100 are in a low-temperature low-humidity state (at 10° C. with the humidity of 20%, which is hereinafter referred to as "LL environment") (step S105).

In addition, if the LL environment is not established (No in the step S105), the controller 41 issues an instruction to instruct the display device 43 to display the message that urges the user to replace the primary transfer roller 15 (step S106) and, as the prolongation processing, switches to the adjustment mode (step S107) and terminates this processing.

Specifically, the controller 41 determines that the primary transfer roller 15 is in the deterioration state which necessitates replacement thereof and urges the replacement.

Also, the adjustment mode is a mode in which the current value applied to the primary transfer mechanism is continuously changed, the tone density on the intermediate transfer belt 17 is detected by the density sensor 20, a current value of a minimum required amount is searched for, where the minimum required amount ensures that the toner density take a predetermined set value is searched for from the result of the detection, and the setting of the current value is changed to this value. It should be noted that the set value of the toner density does not need to be one single point but may also be a value that may vary within a predetermined range.

Accordingly, the setting of the current value can be changed to a value lower than a normal value while the toner density on the intermediate transfer belt 17 is maintained within a range that does not cause a problem, and thus the available time of the primary transfer roller 15 can be prolonged (the life can be extended). By switching to this mode, it is made possible to continue to use the degraded primary transfer roller 15 without decreasing the production efficiency.

It should be noted that instead of detecting the toner density on the intermediate transfer belt 17, the toner density of the image formed on the sheet of paper P may be detected by the image reader 50 and the setting of the current value may be changed to the value of the minimum required amount that ensures that the detected toner density take a predetermined set value.

On the other hand, if the LL environment is established (Yes in the step S105), the controller 41 issues an instruction to instruct the display device 43 to display the message that urges the user to replace the primary transfer roller 15 (step S106) and, as the prolongation processing, switches to the low-speed mode (step S108) and terminates this processing.

Specifically, the controller 41 determines that the primary transfer roller 15 is in the deterioration state which necessitates replacement thereof and urges the replacement.

Also, the low-speed mode is a mode in which the image formation processing speed is slowed down and the setting of the current value to be applied to the primary transfer mechanism is changed to a predetermined second value which is lower than a normal value. By changing to this mode, the production efficiency is decreased in the LL environment but it is made possible to continue to use the degraded primary transfer roller 15.

Also, if the measured value is equal to or larger than the threshold in the above-described step S102 (Yes in the step S102), the controller 41 computes the slope (step S109) in the same manner as in the above-described step S103, and determines whether or not the value of the computed slope is equal to or larger than the preset predetermined value (step S110) in the same manner as in the above-described step S104.

In addition, if the measured value is equal to or larger than the predetermined value (Yes in the step S110), the controller 41 issues an instruction to instruct the display device 43 to display the message that urges the user to replace the primary transfer roller 15 to the display device 43 (step S106), and terminates this processing.

Specifically, the controller 41 determines that the primary transfer roller 15 is in the deterioration state which necessitates replacement thereof and urges the replacement.

On the other hand, if the measured value is smaller than the predetermined value (No in the step S110), the controller 41 issues an instruction to cause the display device 43 to display a message urging the user to clean the primary transfer mechanism (the primary transfer roller 15, the intermediate transfer belt 17, etc.) (step S111), and terminates this processing.

Specifically, the controller 41 determines that the rise in the measured resistance value was caused by contamination and urges cleaning.

<Second Deterioration State Determination Processing>

In addition, the image forming apparatus 100 may also determine the deterioration state of the primary transfer roller 15 and perform the processing to compute the remaining period that elapses until the time at which the replacement of the primary transfer roller 15 becomes necessary. This processing may be performed, for example, when the time that elapsed from the time at which the primary transfer roller 15 had been newly installed is shorter than a predetermined period of time, or when the cumulative number of the images formed after the primary transfer roller 15 was newly installed is smaller than a predetermined number of images. This second deterioration state determination processing will be described below.

Figure 7:
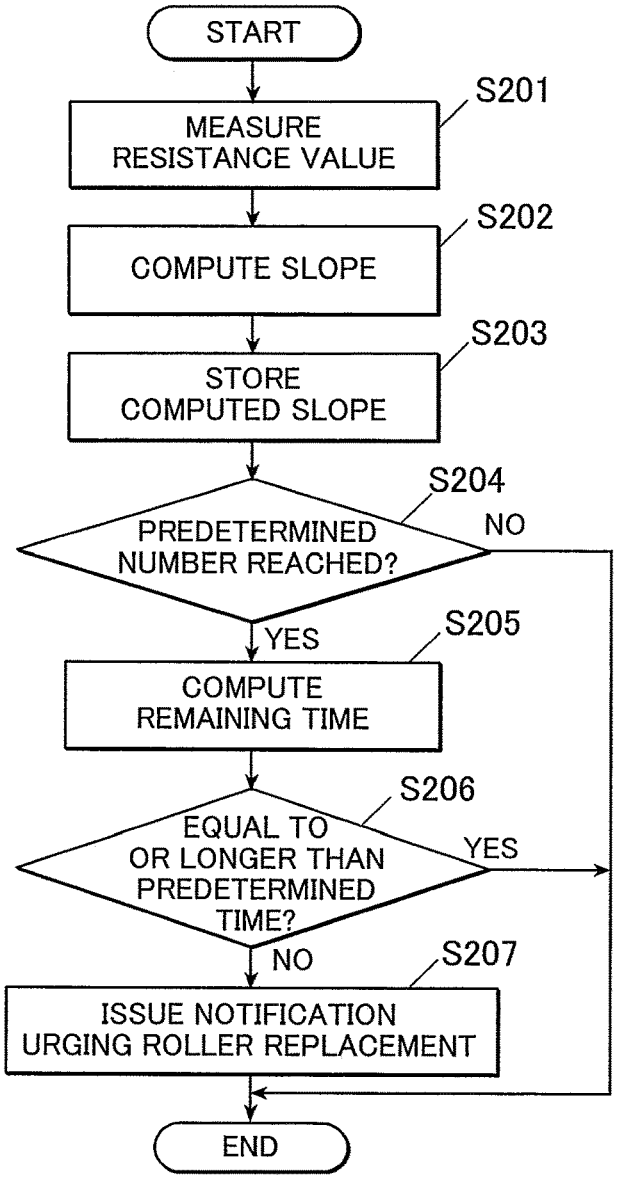
FIG. 7 is a flowchart illustrating second deterioration state determination processing.

FIG. 7 is a flowchart that illustrates the second deterioration state determination processing.

In this second deterioration state determination processing as well, the controller 41 starts the processing in response to the preset inspection point in time having been reached, which is used as the trigger to start the processing.

As illustrated in FIG. 7, first, the controller 41 measures, in the same manner as in the above-described step S101, applies the current values (a1, a2) of two levels and measures the resistance values (R1, R2) (step S201).

It should be noted that in this case as well, in place of the currents, voltages of two levels may be switched between and applied so as to measure the resistance values.

Also, while the description is given on the assumption that the currents (or voltages) of two levels are applied so as to measure the resistance values, currents (or voltages) of three or more levels may be applied to measure the resistance values.

Subsequently, the controller 41, computes, in the same manner as in the above-described step S103, the slope using the current values (a1, a2) and the resistance values (R1, R2) (step S202).

Subsequently, the controller 41 stores the computed slope in the storage device 44 together with the energization time (h) (cumulative usage status) that elapsed by that time for the primary transfer roller 15 (step S203).

It should be noted that, in place of the energization time (h), the energization distance (km) may be stored which is indicative of the rotation distance of the primary transfer roller 15.

Subsequently, the controller 41 determines whether or not the number of data stored in the storage device 44 reaches a predetermined number (step S204), and terminates this processing if it does not reach the predetermined number (No in the step S204).

On the other hand, if it reaches the predetermined number (Yes in the step S204), the controller 41 computes the remaining time in which the primary transfer roller 15 can be used (step S205).

Figure 8:
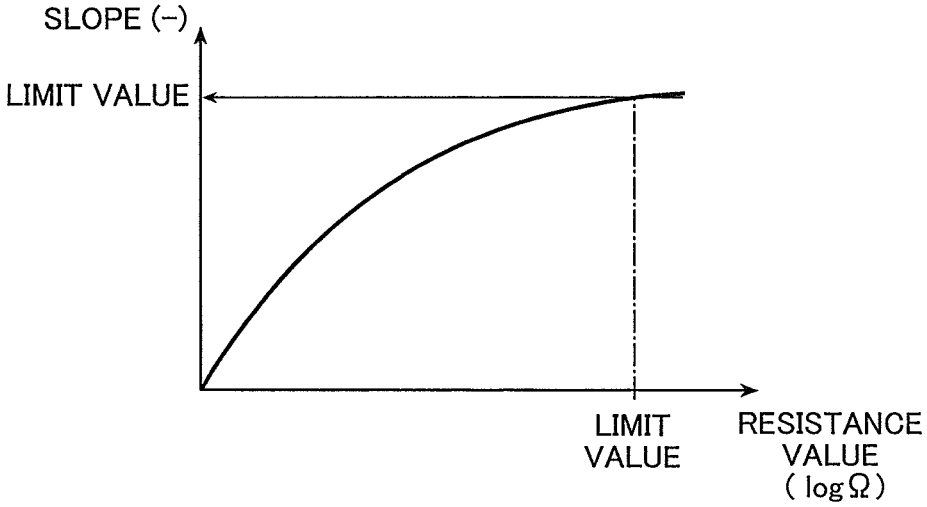
FIG. 8 is a diagram for explanation of computation of a remaining period.

Here, FIG. 8 is an example of a graph that indicates the relationship between the resistance value and the slope. In FIG. 8, the horizontal axis indicates the resistance value (log Ω) and the vertical axis indicates the slope (−). It should be noted that this relationship between the resistance value and the slope is computed in advance by a preliminary experiment or the like.

As can be seen from FIG. 8, the slope value (the limit value of the slope) with respect to the limit value of the predetermined resistance is computed in advance.

Figure 9:
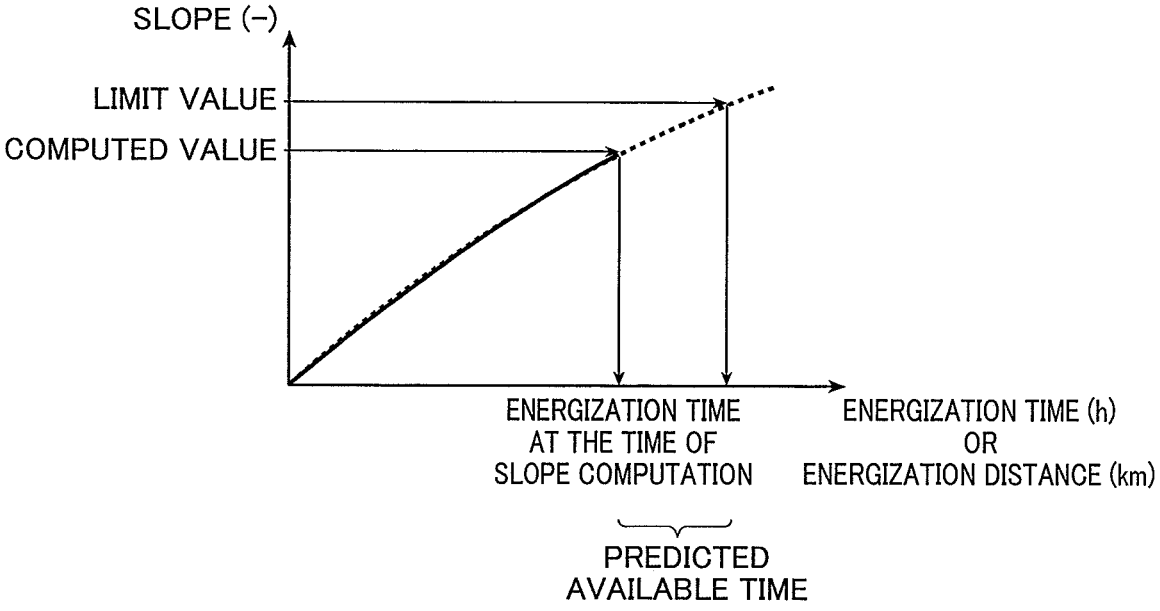
FIG. 9 is a diagram for explanation of computation of the remaining period.

FIG. 9 is an example of a graph in which the values of the slopes computed in the step S202 are plotted in relation to the energization time (h). In FIG. 9, the horizontal axis indicates the energization time (h) and the vertical axis indicates the slope (−).

As illustrated in FIG. 9, the controller 41 computes the time that will elapse until the resistance limit value is reached as the remaining time based on the difference between the slope computed in the above-described step S202 and the slope corresponding to the limit value of the resistance.

Subsequently, the controller 41 determines whether or not the remaining time is equal to or longer than a predetermined length of time (step S206), and terminates this processing if the remaining time is equal to or longer than the predetermined length (Yes in the step S206).

On the other hand, if the remaining time is shorter than a predetermined length (No in the step S206), the controller 41 issues an instruction to cause the display device 43 to display a message notifying the user about the remaining time (the time for replacement) (step S207) and terminates this processing.

[Technical Effect of the Present Embodiment]

As described in the foregoing, according to the present embodiment, the image forming apparatus 100 includes the primary transfer mechanism that transfers the toner images formed on the photosensitive member drums 11Y, 11M, 11C, 11K onto the intermediate transfer belt 17. The primary transfer mechanism includes the primary transfer roller 15 having resistance whose current-voltage characteristic changed according to the energization. The image forming apparatus 100 includes the resistance detector 152 that detects the resistance value obtained when the currents or voltages of two or more levels are switched between and applied to the primary transfer roller 15; and the controller 41 that computes the slope of the current-voltage characteristic from the resistance value detected by the resistance detector 152, and determines the deterioration state of the primary transfer roller 15 based on the computed slope.

As a result, computation of the slope of the current-voltage characteristic of the primary transfer roller 15 makes it possible to discriminate and analyze the resistance fluctuations of the primary transfer roller 15 as a single component so as to determine the deterioration state of the primary transfer roller 15. Hence, it is made possible to replace the primary transfer roller 15 at an appropriate point in time.

Also, according to the present embodiment, the controller 41 issues a notification to the user to urge the user to replace the primary transfer roller 15 in response to the computed slope being equal to or greater than a predetermined value.

As a result, the user is allowed to replace the primary transfer roller 15 at an appropriate point in time.

Also, according to the present embodiment, the controller 41 issues a notification to the user to urge the user to clean the conductive member when the resistance value that has been detected by the detector is equal to or greater than the preset threshold and the computed slope is smaller than the preset predetermined value.

As a result, the user can recognize that the resistance value fluctuates due to contamination.

Also, according to the present embodiment, the controller 41 performs the prolongation processing to prolong the available time of the primary transfer roller 15 in accordance with the condition of the installation environment when the computed slope is equal to or greater than a predetermined value.

As a result, it is made possible to continue to use the primary transfer roller 15 even when it is in a state in which it is determined that the replacement of the primary transfer roller 15 is necessary.

Also, according to the present embodiment, the density sensor 20 is provided which detects the density of the toner image transferred on the intermediate transfer belt 17. The controller 41 changes, as the prolongation processing, the setting of the current value applied to the primary transfer roller 15 to a value of a required amount ensuring that the toner density detected by the density sensor 20 take the set value.

As a result, it is made possible to continue to use the primary transfer roller 15 without decreasing the production efficiency even when the primary transfer roller 15 is in a state in which it is determined that the replacement thereof is necessary.

Also, according to the present embodiment, it is also possible to use, as the density detector, the image reader 50 that reads the image formed on the sheet of paper P.

As a result, the setting of the current value can be changed based on the image density of the image formed on the sheet of paper P, and the image quality can be maintained at a more favorable level at the time of execution of the prolongation processing.

Also, according to the present embodiment, the controller 41 issues a notification to the user to urge the user to clean the primary transfer roller 15 when the resistance value that has been detected by the density sensor 20 is equal to or greater than the preset threshold and the computed slope is smaller than the preset predetermined value.

As a result, the user can recognize that the resistance value fluctuates due to contamination.

Also, according to the present embodiment, the storage device 44 is provided which stores the cumulative usage status of the primary transfer roller 15. The controller 41 computes the time that will elapse until the primary transfer roller 15 reaches the preset upper limit resistance value on the basis of the cumulative usage status stored in the storage device 44 and the computed slope.

As a result, the user can recognize the remaining time to the replacement for the individual primary transfer rollers 15 and replace the primary transfer roller 15 at an appropriate point in time.

MODIFIED EXAMPLE

It should be noted that the modes of implementation where the present invention is applicable are not limited to the above-described embodiment and various modifications can be made thereto without departing from the scope of the present invention.

For example, the predetermined value used in the determinations at the steps S104 and S110 in the first deterioration state determination processing may be changed in accordance with the conditions of an installation environment such as the temperature and humidity around the image forming apparatus 100.

Figure 10:
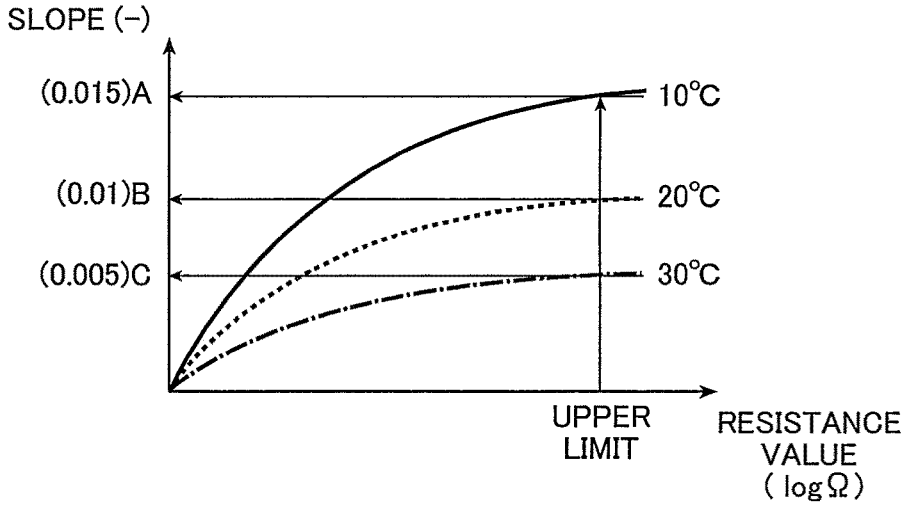
FIG. 10 is an example of a graph illustrating temperature dependence of the slope value relative to a resistance value.

FIG. 10 is a graph that illustrates the temperature dependence of the resistance value and the slope. In FIG. 10, the horizontal axis indicates the resistance value (log Ω) and the vertical axis indicates the slope (−).

As illustrated in FIG. 10, a lower temperature in the installation environment of the image forming apparatus 100 corresponds to a smaller slope value in relation to the upper limit of the resistance value. As a result, after the computation of the slope, the setting of the predetermined value used in the determinations at the steps S104 and S110 may be changed in accordance with the temperature of the installation environment of the image forming apparatus 100. For example, if the temperature of the installation environment is 30° C. or higher, then the predetermined value may be set to 0.005. If the temperature of the installation environment is 20° C. or higher and 30° C. or lower, then the predetermined value may be set to 0.01. If the temperature of the installation environment is 20° C. or lower, then the predetermined value may be set to 0.015.

This setting makes it possible to notify the point in time to replace the primary transfer roller 15 to the user more accurately.

Also, while the present invention is effective in a composite device incorporating an ion conductive member (primary transfer roller 15) and an electronic conductive member (intermediate transfer belt 17, photosensitive member drum 11), as long as the characteristics of the individual components of the composite device are recognized in advance, the resistance fluctuations of the individual members can be discriminated and analyzed even when a plurality of ion conductive members are provided, which makes it possible to determine the deterioration states of the individual components.

At this point, the current (or voltage) to be applied may be measured at any number of locations as long as these locations include at least two or more locations where the characteristics of the individual components recognized in advance can be most readily detected.

Figure 11:
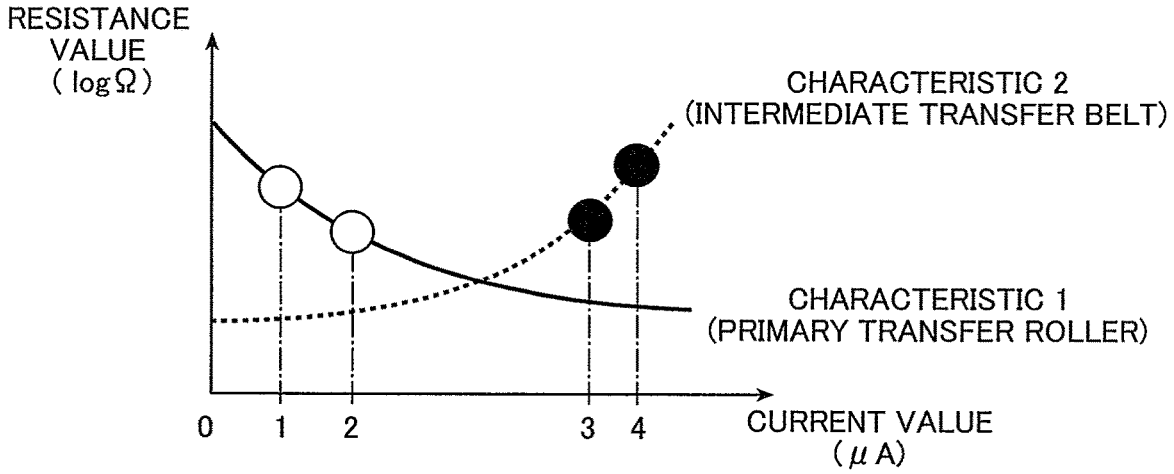
FIG. 11 is an example of a graph illustrating characteristics of the resistance values for each component relative to a current value.

For example, as illustrated in FIG. 11, the results obtained by application of currents of three or more levels to measure the resistance values may be broken down into the individual characteristics to detect the individual characteristics.

Also, even when the characteristics cannot be identified in advance because, for example, the inflection point changes over time, the characteristics may be predicted by measuring the resistance values at three or more levels.

Also, in the above-described embodiment, the determination of whether or not the LL environment is established is performed when the slope is equal to or greater than the predetermined value. However, the mode of implementation of the control may be such that such a determination is not performed. In other words, the mode of implementation of the control may be such that the mode change is not performed.

Also, in the above-described embodiment, determination of whether or not the resistance value is equal to or larger than the threshold is performed at the stage where the same resistance value is measured. However, the mode of implementation of the control may be such that such a determination is not performed. In other words, the mode of implementation of the control may be such that whether or not the cleaning is necessary is not determined.

Also, in the above-described embodiment, the explanations have been provided on the basis of the example of the image forming apparatus having the configuration in which the toner image formed on the photosensitive member is transferred onto the intermediate transfer belt as the transfer receiving member. However, the image forming apparatus may have a configuration in which the toner image is transferred onto the sheet of paper P as the transfer receiving member without using the intermediate transfer belt.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-046219, filed on 14 Mar. 2018, is incorporated herein by reference in its entirety.

What is claimed is:

1. An image forming apparatus comprising:

a transfer mechanism which transfers a toner image formed on a photosensitive member onto a transfer receiving member, the transfer mechanism including a conductive member having resistance whose current-voltage characteristic changes by energization;

a detector which detects a resistance value when currents or voltages of two or more levels are switched from one to another and applied to the conductive member; and a hardware processor which computes a slope of the current-voltage characteristic from the resistance value detected by the detector and determines a deterioration state of the conductive member by the slope.

2. The image forming apparatus according to claim 1, wherein the hardware processor issues a notification urging replacement of the conductive member to a user when the computed slope is equal to or greater than a predetermined value.

3. The image forming apparatus according to claim 2, wherein the hardware processor changes the predetermined value in accordance with a condition of an installation environment.

4. The image forming apparatus according to claim 1, wherein the hardware processor performs prolongation processing to prolong an available time of the conductive member in accordance with a condition of an installation environment when the computed slope is equal to or greater than the predetermined value.

5. The image forming apparatus according to claim 4, further comprising a density detector which detects a density of the toner image transferred onto the transfer receiving member, wherein, as the prolongation processing, the hardware processor changes setting of a current value applied to the conductive member to an amount necessary for the toner density detected by the density detector to correspond to a setting value.

6. The image forming apparatus according to claim 5, wherein the density detector is an image reader reading an image formed on a sheet of paper.

7. The image forming apparatus according to claim 1, wherein the hardware processor issues a notification urging cleaning of the conductive member to a user when a resistance value detected by the detector is equal to or greater than a preset threshold and the computed slope is equal to or smaller than a preset value.

8. The image forming apparatus according to claim 1, further comprising a storage device which stores a cumulative usage status of the conductive member, wherein the hardware processor computes a time that elapses until the conductive member reaches a preset upper limit resistance value from the cumulative usage status stored in the storage device and the computed slope.

9. The image forming apparatus according to claim 1, wherein the conductive member is an ion conductive member.

10. A non-transitory computer readable storage medium storing a program for a computer of an image forming apparatus, the image forming apparatus including a transfer mechanism including a conductive member having resistance whose current-voltage characteristic changes by energization and transferring a toner image formed on a photosensitive member onto a transfer receiving member, and a detector which detects a resistance value when currents or voltages of two or more levels are switched from one to another and applied to the conductive member, the program causing the computer to:

compute a slope of the current-voltage characteristic from the resistance value detected by the detector; and determine a deterioration state of the conductive member by the slope.

* * * * *